US007383671B2

(12) United States Patent
Conti

(10) Patent No.: US 7,383,671 B2
(45) Date of Patent: Jun. 10, 2008

(54) BLISTERING MACHINE FOR PRODUCING BLISTER PACKS

(75) Inventor: Roberto Conti, Imola (IT)

(73) Assignee: I.M.A. Industria Macchine Automatiche S.p.A., Ozzano Emilia (Bologna) (IT)

( * ) Notice: Subject to any disclaimer, the term of this patent is extended or adjusted under 35 U.S.C. 154(b) by 0 days.

(21) Appl. No.: 11/579,262

(22) PCT Filed: May 6, 2005

(86) PCT No.: PCT/IB2005/001269

§ 371 (c)(1),
(2), (4) Date: Nov. 1, 2006

(87) PCT Pub. No.: WO2005/108209

PCT Pub. Date: Nov. 17, 2005

(65) Prior Publication Data

US 2007/0220827 A1 Sep. 27, 2007

(30) Foreign Application Priority Data

May 7, 2004 (EP) ..... 04425327

(51) Int. Cl.

| | |
|---|---|
| ***B65B 47/00*** | (2006.01) |
| ***B65B 9/04*** | (2006.01) |
| ***B65B 61/02*** | (2006.01) |
| ***B65B 61/26*** | (2006.01) |

(52) U.S. Cl. ..... 53/131.3; 53/131.5; 53/559; 53/374.6

(58) Field of Classification Search ..... 53/559, 53/131.2–131.5, 373.4, 373.5, 374.4–374.6; *B65B 47/00*
See application file for complete search history.

(56) References Cited

U.S. PATENT DOCUMENTS 3,237,371 A * 3/1966 Gerlach ..... 53/374.6

(Continued)

FOREIGN PATENT DOCUMENTS

DE 2 031 896 1/1972

(Continued)

*Primary Examiner*—Stephen F Gerrity
(74) *Attorney, Agent, or Firm*—William J. Sapone; Coleman Sudol Sapone P.C.

(57) ABSTRACT

A blistering machine (M1) for producing blister packs (B1) has a production line including, arranged in a series: at least one thermoforming station (101) of a first continuous band (102) of thermoformable material, in order to define a blister band (102) with blisters containing products (104); a station (105) for feeding the products (104) and filling the blister band (102) with the products; a feeding station (106) of a second band (107), feeding continuously the second band (107) over the blister band (102) to form a blister pack band (NB1); a closing station (108), where the first blister band (102) is sealed by the second band (107) to obtain a blister pack; a station (200) for processing the blister pack band (NB1); and a cutting station (R1), in which the blister pack band is cut into respective blister packs (B1) filled with the products (104). The production line extends, at least beginning from the products feeding station (105), along a continuous feeding path (A1), substantially horizontal. The processing station (200), along the path (A1), is defined by at least one printing/debossing station (109,110) of the blister pack band (NB1), which includes a printing/debossing device (135,136), moving continuously toward and away from the blister pack band (NB1) and following the blister pack band (NB1) along the path (A1).

1 Claim, 7 Drawing Sheets

U.S. PATENT DOCUMENTS

| | | | | | |
|---|---|---|---|---|---|
| 3,343,336 | A | * | 9/1967 | Bradford | 53/559 |
| 3,354,611 | A | * | 11/1967 | Powell | 53/559 |
| 3,397,508 | A | * | 8/1968 | Stroop | 53/559 |
| 3,438,173 | A | * | 4/1969 | Shozo | 53/479 |
| 3,851,441 | A | * | 12/1974 | Marchand | 53/116 |
| 3,874,143 | A | | 4/1975 | Braber | |
| 4,033,092 | A | * | 7/1977 | Vetter | 53/131.5 |
| 4,064,676 | A | * | 12/1977 | King et al. | 53/559 |
| 4,069,645 | A | * | 1/1978 | Vetter | 53/559 |
| RE29,937 | E | * | 3/1979 | Mahaffy et al. | 53/559 |
| 4,199,919 | A | * | 4/1980 | Moscatelli | 53/552 |
| 4,233,801 | A | * | 11/1980 | Watt | 53/453 |
| 4,240,241 | A | * | 12/1980 | Sanborn, Jr. | 53/412 |
| 4,563,860 | A | * | 1/1986 | Pfankuch | 53/374.6 |
| 4,726,173 | A | * | 2/1988 | Giatti | 53/559 |
| 4,819,406 | A | * | 4/1989 | Redmond | 53/51 |
| 4,894,977 | A | * | 1/1990 | Rittinger et al. | 53/453 |
| 4,897,985 | A | * | 2/1990 | Buchko et al. | 53/559 |
| 5,269,123 | A | * | 12/1993 | Marchesini | 53/559 |
| 5,307,610 | A | * | 5/1994 | Schneider et al. | 53/559 |
| 5,517,805 | A | * | 5/1996 | Epstein | 53/559 |
| 5,685,131 | A | * | 11/1997 | Spatolisano et al. | 53/550 |
| 6,109,000 | A | * | 8/2000 | Conti | 53/51 |
| 6,178,726 | B1 | * | 1/2001 | Takigawa | 53/451 |
| 6,334,288 | B1 | * | 1/2002 | Amaranti et al. | 53/131.2 |
| 6,679,031 | B2 | * | 1/2004 | Tampieri | 53/453 |
| 6,843,038 | B1 | * | 1/2005 | Haws | 53/133.4 |
| 6,941,729 | B2 | * | 9/2005 | Dal Pozzo | 53/453 |

FOREIGN PATENT DOCUMENTS

| | | | |
|---|---|---|---|
| DE | 24 37 128 | A1 | 2/1976 |
| DE | 31 41 528 | A1 | 5/1983 |
| DE | 102 41 802 | A1 | 3/2004 |
| WO | WO 03/035478 | A1 | 5/2003 |

* cited by examiner

BLISTERING MACHINE FOR PRODUCING BLISTER PACKS

FIELD OF THE INVENTION

The present invention relates to a blistering machine for producing blister packs.

In particular, the invention is advantageously applied to the production of blister packs containing pharmaceutical products, such as tablets, capsules, pills, pellets and the like, to which the following description will refer without loosing its general character.

BACKGROUND OF THE INVENTION

At present, a known blistering machine M for producing blister packs, according to FIG. 1 (prior art) includes: a station 1, in which a first continuous band 2 of thermoformable material (e.g. PVC) is thermoformed to define a blister band with blisters 3 containing products 4, the blister band 2 being driven continuously along a determined feeding path A having a varying course; a station 5 for feeding products 4, including a unit for filling each blister 3 with a product 4; a station 6 for driving a second continuous band 7 (e.g. of aluminium), feeding continuously the second continuous band 7 over the blister band 2 filled with the products 4; a station 8 for closing the first blister band 2 with the second band 7 by heat-sealing, in order to obtain a continuous blister pack band NB.

Downstream of the closing station 8, along the feeding path A of varying course, there is also a station 9, where the continuous blister pack band NB is printed or punched, and a station 10, where the continuous blister band NB is pre-cut, to define pre-cut lines on the continuous blister pack band NB.

Afterwards, the continuous blister pack band NB with the pre-cut lines is divided, e.g. by shearing at a cutting station R, to define a plurality of single blister packs B.

Downstream of the cutting station R, the single blister packs B are collected and fed to a boxing +unit C, to be packaged in suitable boxes in known way.

Generally, the printing station 9, as well as the pre-cutting station 10 include a pair of opposed plates working alternately to move toward and away from the blister band NB.

Since the first band 2, as well as the second band 7, and consequently, the band NB, are fed continuously, it is necessary to make this continuous feeding of the band NB compatible with the alternate motion of the means in the printing station 9 and the pre-cutting station 10.

For this purpose, the machine M includes a bending roller 11, which bends the band NB downstream of the closing station 8 and makes it move along an acute angle curved portion of the feeding path A defining a loop K.

The idler roller 11, defining the loop K, is a so-called "dancing" roller, that is a roller, which is made oscillate between different working positions, in order to allow to make up for the continuous feeding of the band NB along the path A.

Although the above described configuration bending roller 11—loop K is efficient in making the continuous movement of the band NB compatible with the alternate movements of the stations 9 and 10, it constitutes a limit to the possibility of increasing the productive speed of the blistering machine M.

Moreover, this configuration increases the dimensions of the blistering machine M.

SUMMARY OF THE INVENTION

The object of the present invention is to propose a blistering machine, whose structure is simpler and more compact with respect to the known blistering machines, described above, which results in a considerable reduction of dimensions.

In particular, an object of the present invention is to simplify the structure and functionality of the printing and pre-cutting stations, so as to make them compatible with the feeding of the blister band, on which they are to work, so as to allow an increase in the production speed of the whole blistering machine.

Another object of the present invention is to improve the functionality of the systems for feeding band materials to a blistering machine.

According to the present invention, a blistering machine for producing blister packs includes a production line, which comprises consecutively at least one thermoforming station of a first continuous band of thermoformable material, in order to define a blister band with blisters containing products; a station for feeding said products and filling said blister band with the latter; a feeding station of a second band, feeding the second band continuously over said blister band filled with the products; a closing station, where the first blister band is sealed by said second band to obtain a blister pack band; a station, where the blister pack band is treated, and a cutting station, in which said blister pack band is cut into respective blister packs; the machine being characterized in that said production line extends, at least beginning from said products feeding station, along a continuous feeding path, substantially horizontal; along said path, said treating station is defined by at least one printing/debossing station for said blister pack band, which includes printing/debossing means, moving continuously towards and away from the blister pack band, following the latter along said path.

BRIEF DESCRIPTION OF THE DRAWINGS

The technical features of the invention, according to the above objects, are clearly understood from the contents of the claims below, and the advantages of the invention will be better seen from the following detailed description, with reference to the enclosed figures, which show a preferred embodiment, as a pure, not limiting example, in which:

BEST MODES OF CARRYING OUT THE INVENTION

Figure 2:
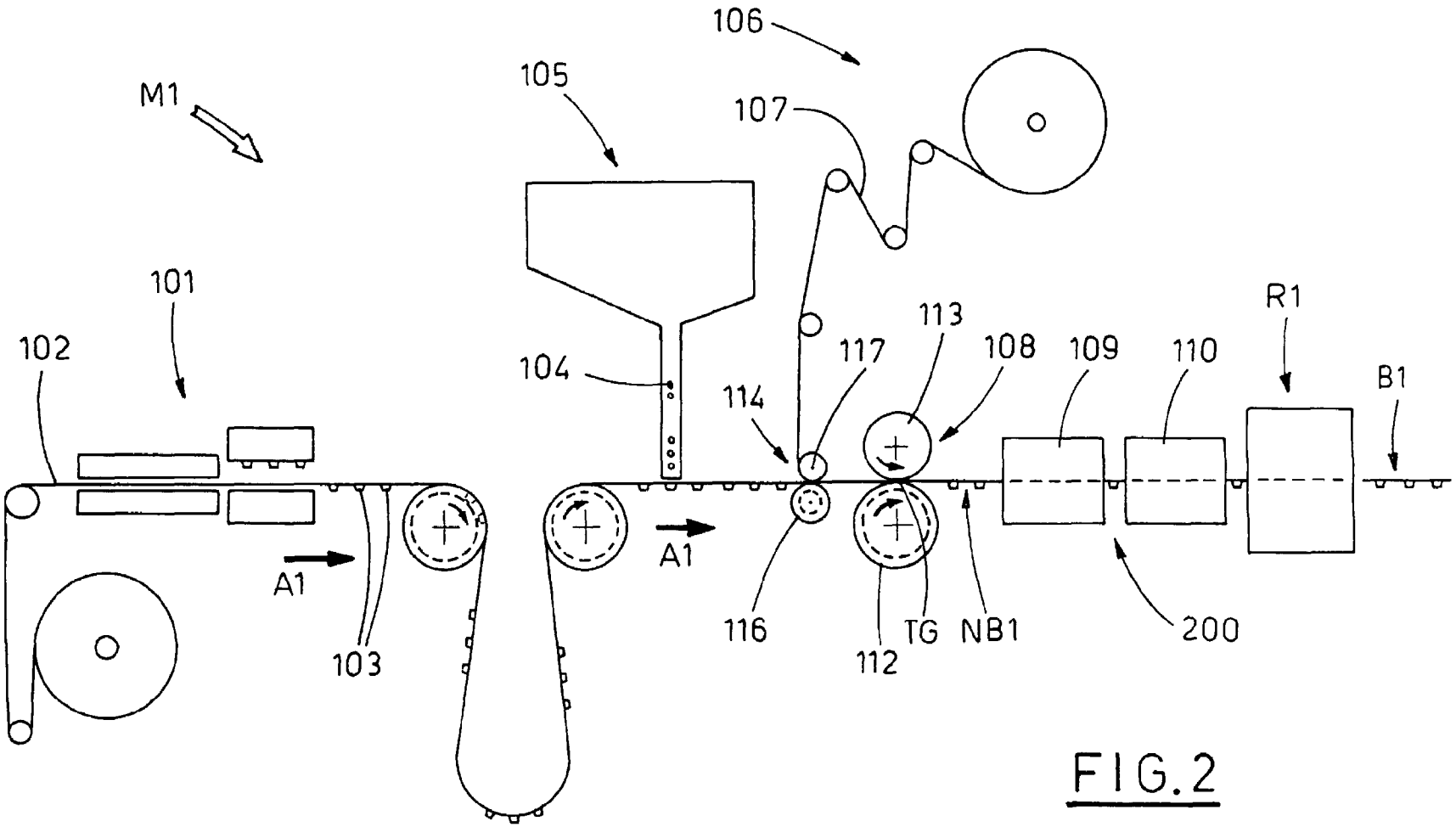
FIG. 2 is a schematic front view of a preferred embodiment of the blistering machine proposed by the present invention.

With reference to FIG. 2, the reference M1 indicates generally a blistering machine proposed by the present invention, for producing blister packs containing products, preferably pharmaceutical.

For simplicity of the description and clarity of the comparison between the machine M1 proposed by the invention and the machine M of the prior art, the constituent elements of the machine M1 shown in FIG. 2 will be described and indicated with reference numbers defined by the same reference numbers (where present and where it is possible) used for describing the machine M, summed to the base number 100: therefore, the number 101 indicates the thermoforming station of the machine M1, which corresponds to the number 1 indicating the thermoforming station of the blistering machine M of the prior art, and so on.

Thus, the blistering machine M1 is defined by a production line including a station 101, where a first continuous band 2 of thermoformable material (e.g. PVC) is thermoformed, so as to obtain a blister band 102 with blisters 103 containing products 104; the blister band 102 being fed in a substantially continuous way along a predetermined feeding path A1; a station 105 for feeding the products 104 having a unit for filling each blister 103 with a relative product 104; a feeding station 106 of a second band 107 (e.g. aluminium), feeding the second band continuously over the blister band filled with the products; a closing station 108, where the first blister band is closed by the second band 107 by heat sealing, to obtain a continuous blister band NB1.

Downstream of the closing station 108, along the linear feeding path A, the machine M includes also a processing station 200 for the continuous blister band NB1, defined by at least one station 109, where the continuous blister pack band NB1 is printed or punched in order to apply thereon codes and/or marks, and preferably, a station 110, where the continuous blister band NB1 is pre-cut/incised, to define pre-cut lines on the continuous blister pack band NB1.

Afterwards, the continuous blister pack band NB1 with the pre-cut lines is divided, e.g. by shearing in a cutting station R1, to define a plurality of single blister packs B1.

Downstream of the cutting station R1, the single blister packs B1 are collected and fed to a boxing unit (known and not shown), to be packaged in suitable boxes in known way.

Figure 1:
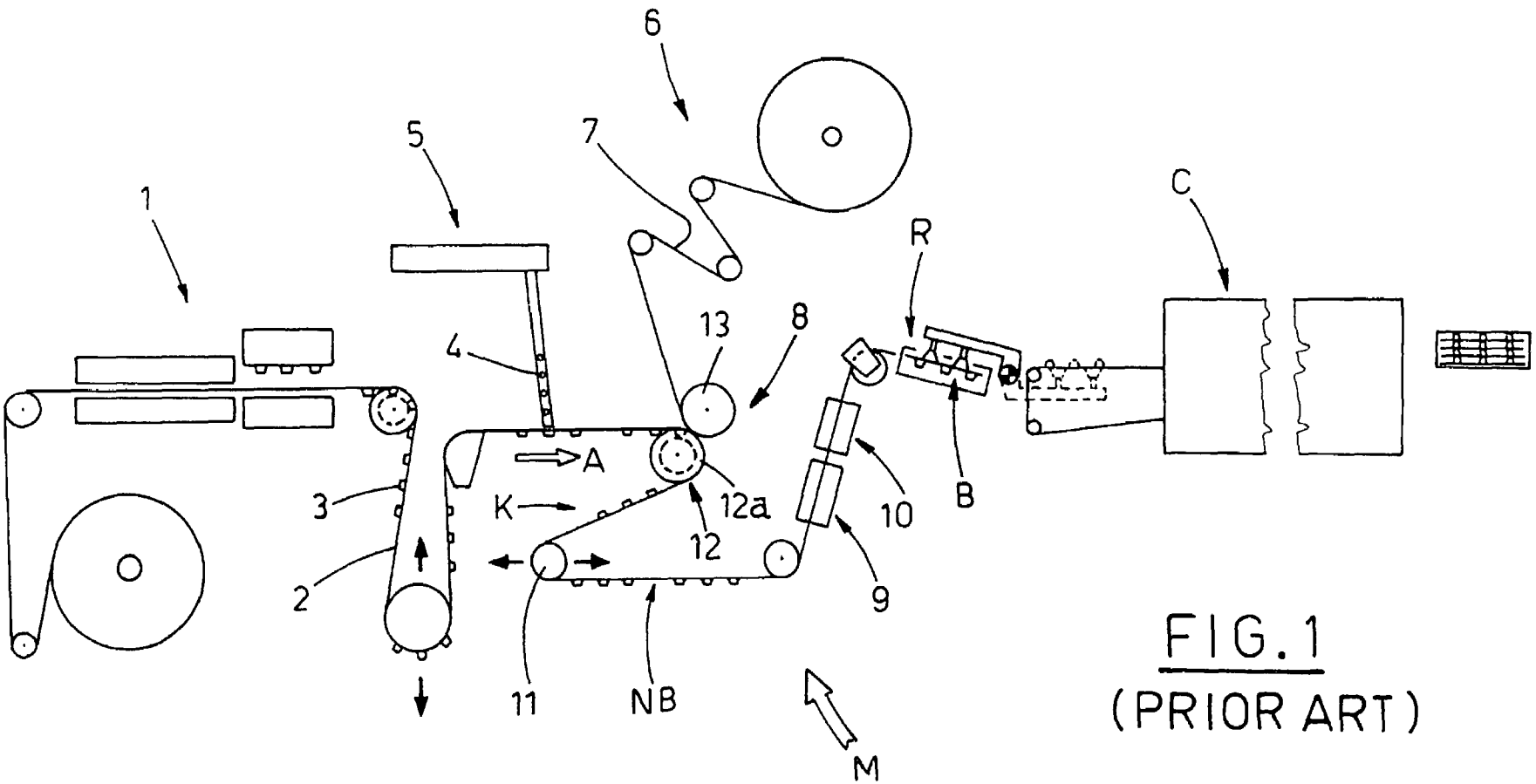
FIG. 1 (PRIOR ART)
FIG. 1 is a schematic, perspective view of a known blistering machine (Prior Art)

Comparing the machine M1 of FIG. 2 of the present invention with the machine M of the prior art shown in FIG. 1, it is easily seen that while the path A of the machine M has a varying course (note for example the acute angle curved path in a region corresponding to the loop K of the band NB, made by the oscillating bend roller 11), the feeding path A1 of the band 102 in the machine M1 extends horizontally, at least beginning from the station 105 for feeding products 104.

In other words, just a single sight allows to notice that the production line of the blistering machine M1 is horizontal, that is it is structured in a simpler and compacter way, and consequently, it reduces considerably dimensions normally occupied by the machine M of the prior art.

According to FIG. 2, the closing station 108 for sealing the band 102 with the band 107 has a couple of rollers 112, 113, which are arranged at the opposite side with respect to the bands 102, 107.

The roller 112, situated at the lower level, is a driving roller having seats (not shown) for coupling with the blisters 3 of the blister band 102, while the upper roller 113, situated opposite the roller 112 and cooperating therewith, is a heated sealing roller.

In particular, it is to be noted that during the feeding along the horizontal path A1, the pulling roller 112 is completely coupled with the blister band 102 in a single line corresponding to a line TG of contact with the sealing roller 113.

Still according to FIG. 2, upstream of the closing station 108 with respect to the feeding along the path A1, the machine M1 includes a group 114 for tensioning the bands 102 and 107.

The group 114, including a pair of rollers 116, 117, facing each other, allow the pair of bands 102 and 107 to advance horizontally with the best tension, thus allowing an efficient mutual coupling of the bands 102, 107 in the station 108, without slipping and with the best setting and pulling of the blisters 103 by the seats of the roller 112, although the band 102 can adhere to the roller 112 only in correspondence to the contact line TG.

According to FIGS. 3 to 9, the printing station 109 and the pre-cutting/incision station 110 of the station 200 of the machine M1 are structurally identical and they operate continuously on the band NB1 fed continuously, since they include working means, which follow the band NB1.

Figure 3:
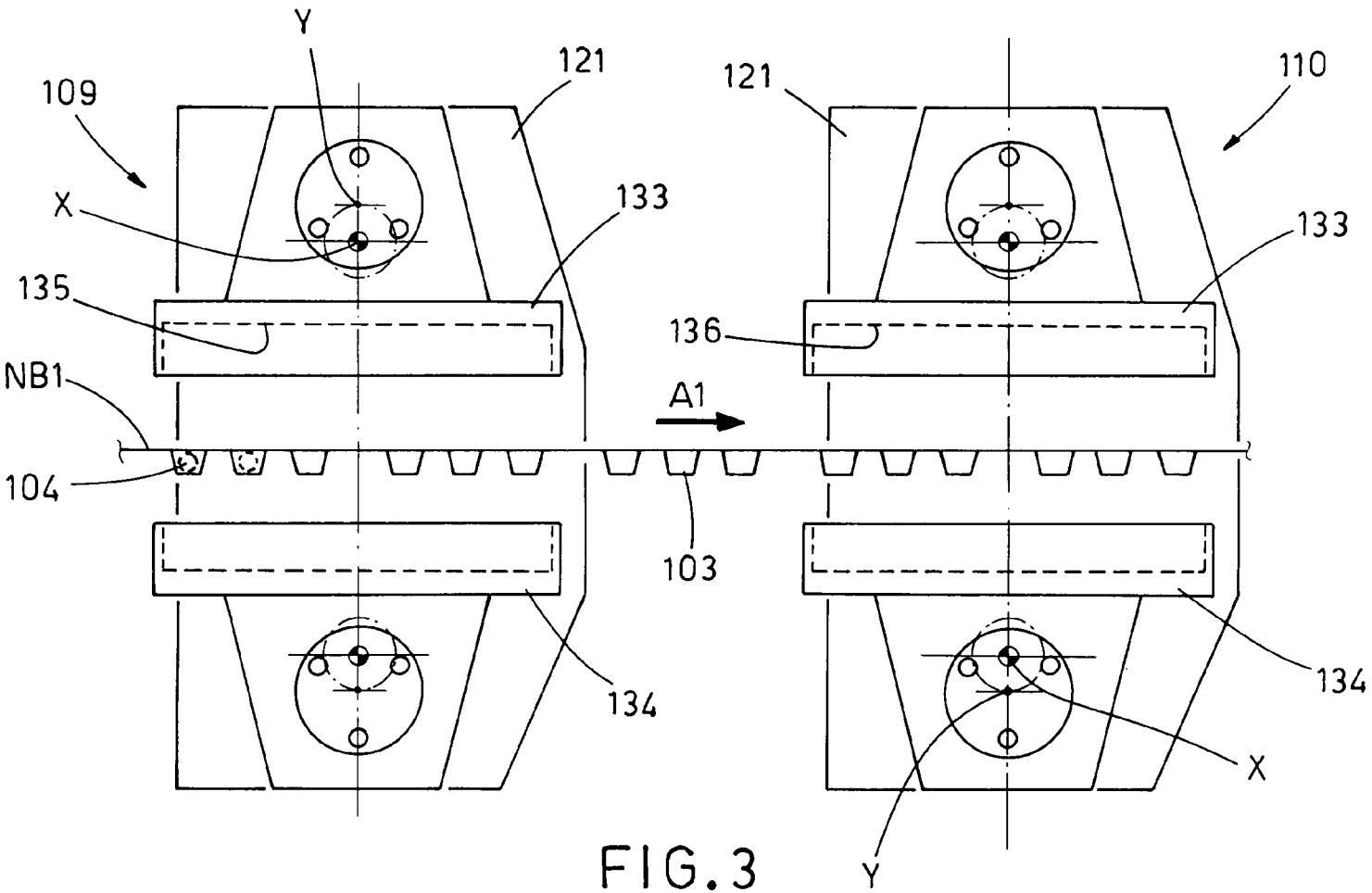
FIG. 3 is a front view, with some parts removed for sake of clarity, of two identical work stations of the blistering machine of FIG. 2.

In particular, as it can be seen in FIG. 3, the station 109, as well as the station 110 include two supporting plates or elements 133 and 134, facing each other, situated on the opposite sides of the blister band NB1.

The station 109 includes also means 135 for punching/printing the band NB1, while the station 110 includes means 136 for incision/pre-cutting of the blister band NB1 (the means 135 and 136 are of known type and are indicated with broken line in FIG. 3).

Each station 109, 110 includes also means 137 for operating and controlling the supporting elements 133 and 134, to define an alternative working cycle (partially seen in FIGS. 6 to 8), with a first working step of going close to, touching and feeding in accordance and synchronized with the band NB1 (following with the forth motion, and a second working step of going far from the band NB1, discordant with (or back motion) and synchronized with respect to the feeding of the band NB1, in accordance with the horizontal path A1.

Figure 4:
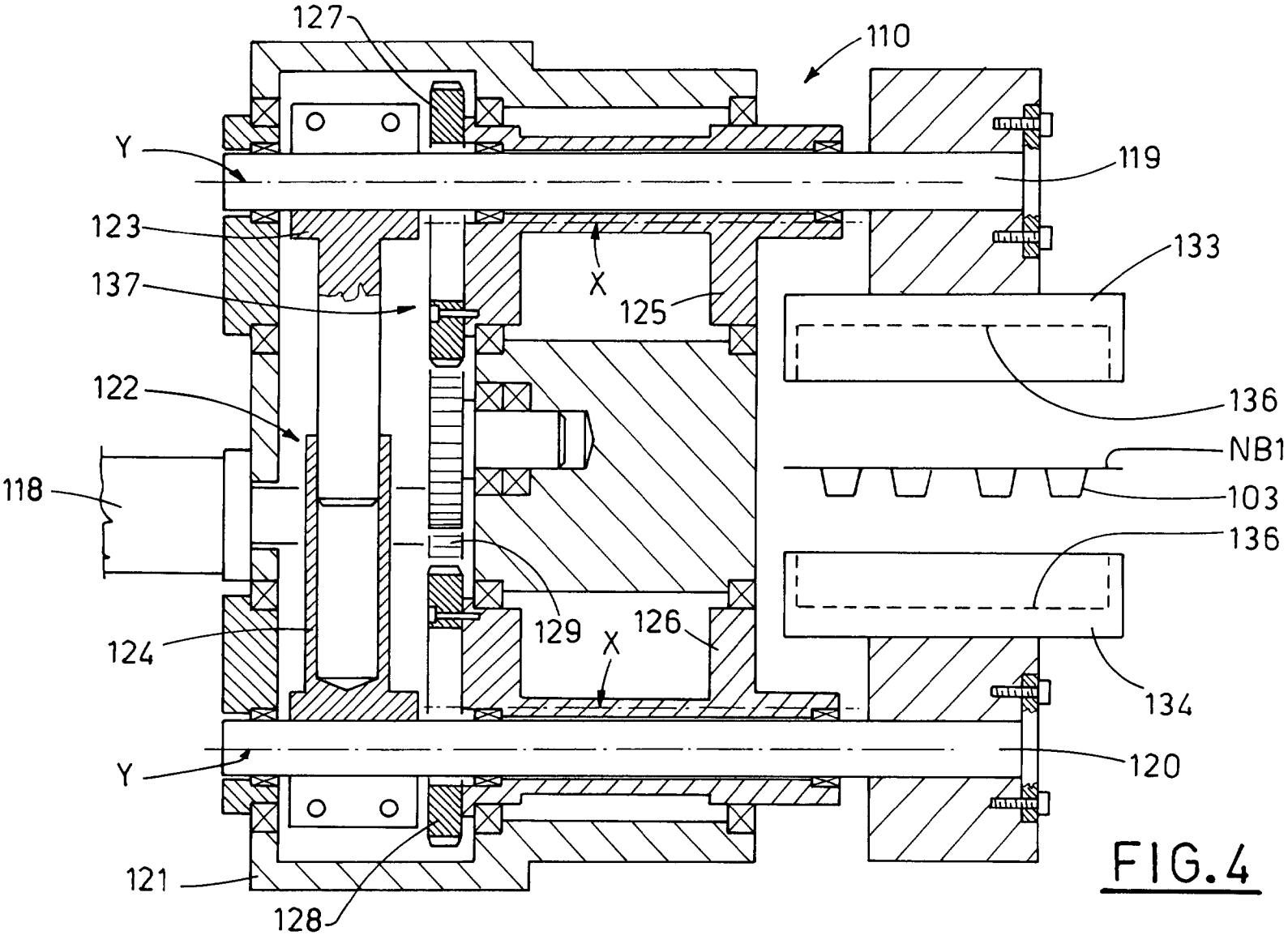
FIG. 4 and FIG. 5 are lateral views of one of the work stations of FIG. 3.
Figure 5:
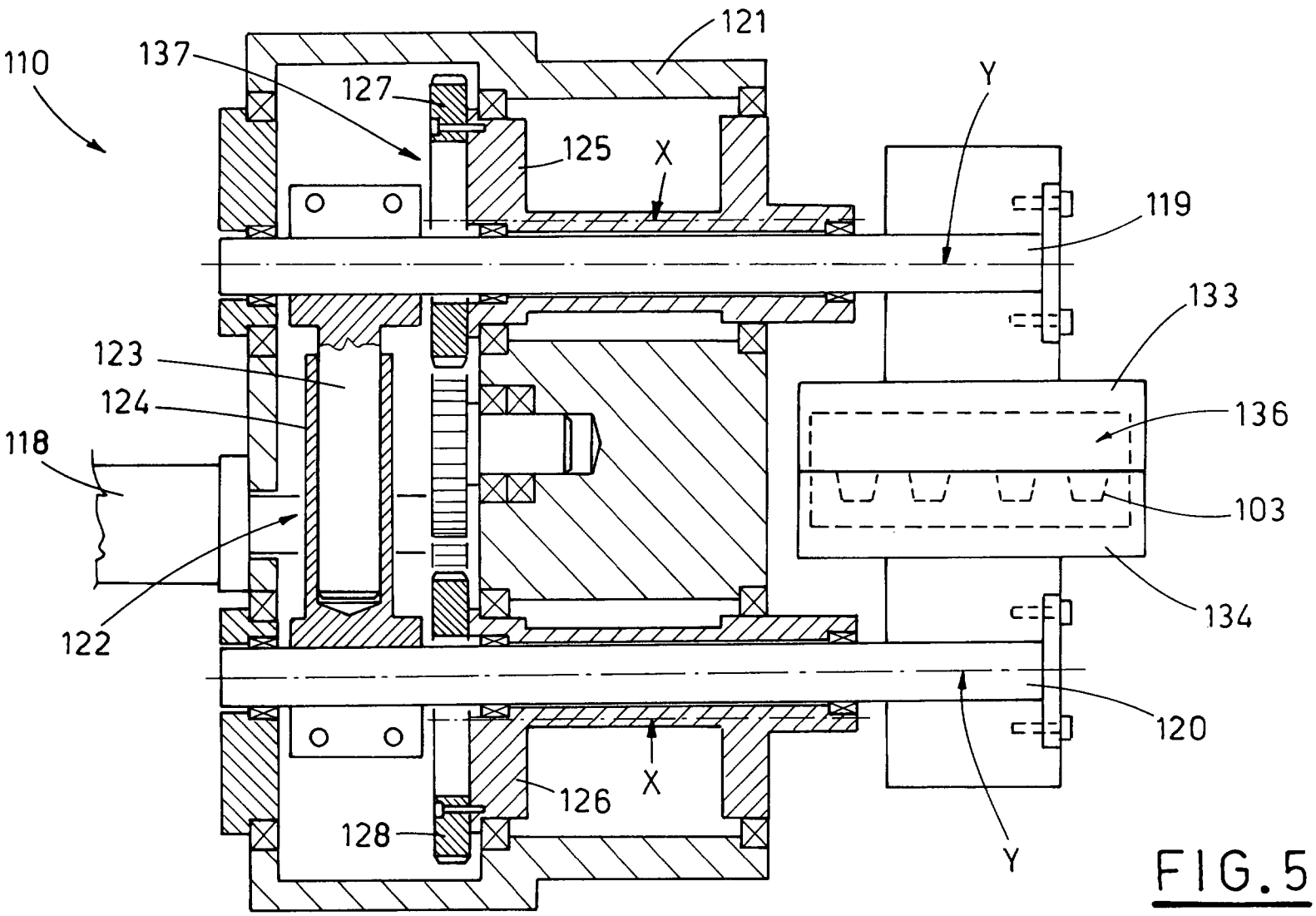

According to FIGS. 4 and 5, where only the incision/pre-cutting station 110 is seen (because the two stations 109 and 110 are analogous and are different only in the stamping or incising means supported by the elements 133 and 134), the operating and controlling means of each station 109, 110 include crank means 137 acting between each support element 133 and 134 and motorization means 118 to allow the support elements 133 and 134 a relative trajectory corresponding to working cycle, that is with mutual moving away (seen in FIG. 4) and moving close (seen in FIG. 5), continuous and synchronized with the feeding of the band NB1 in each pair of supporting elements 133 and 134 and in such a way as to allow the action of the relative means 135 and 136 in a region corresponding to the predefined areas of the band NB1.

From the structural point of view, each support element 133, 134 includes a plate, to which relative punching/stamping and incision/pre-cutting means 135 and 136 are connected.

Each plate 133, 134 is integral with a support shaft 119 and 120 housed inside a framework 121.

Each of the shafts 119, 120 are acted on by crank means 137 and means 122 of reciprocal parallel alignment of the pair of opposite plates 133 and 134.

More in detail, the alignment means 122 include two arms 123, 124, rigidly connected to relative supporting shafts 119, 120 in correspondence to the end, which is most distant from the plates 133 and 134.

The two arms 123 and 124 are slidingly coupled one inside the other to define a telescopic system, which avoids a rotation of the support shafts 119 and 120 on their axes, maintains the latter parallel to each other, all this during the operation of the crank means 137.

The crank means 137 include a tubular element 125, 126 for each shaft 119, 120, which is partially housed inside the tubular element 125, 126.

Each tubular element 125, 126 is connected to a relative ring 127, 128, toothed outside and situated in correspondence to an end of the tubular element 125, 126, which is most distant from the plates 133, 134.

Each toothed ring 127, 128 is set in engagement with a toothed roller 129, powered by the operating means 118 (partially shown in FIGS. 4 and 5).

Figure 7:
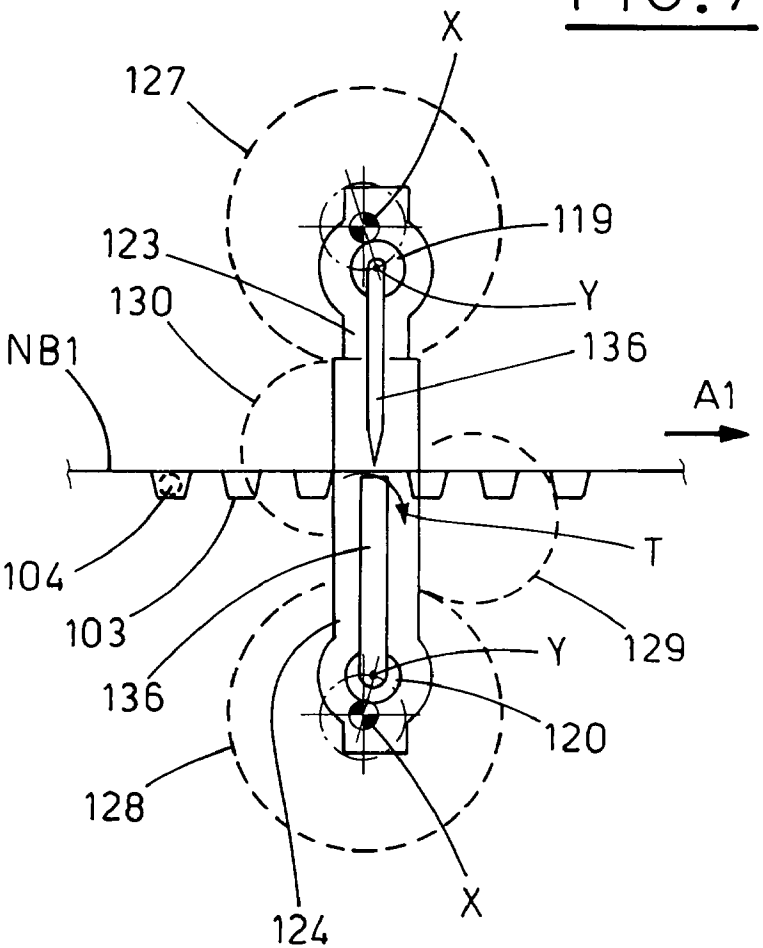
FIGS. 7 to 9 are schematic front views of corresponding moments of one part of the kinematic movement performed by the stations shown in the previous Figures.
Figure 9:
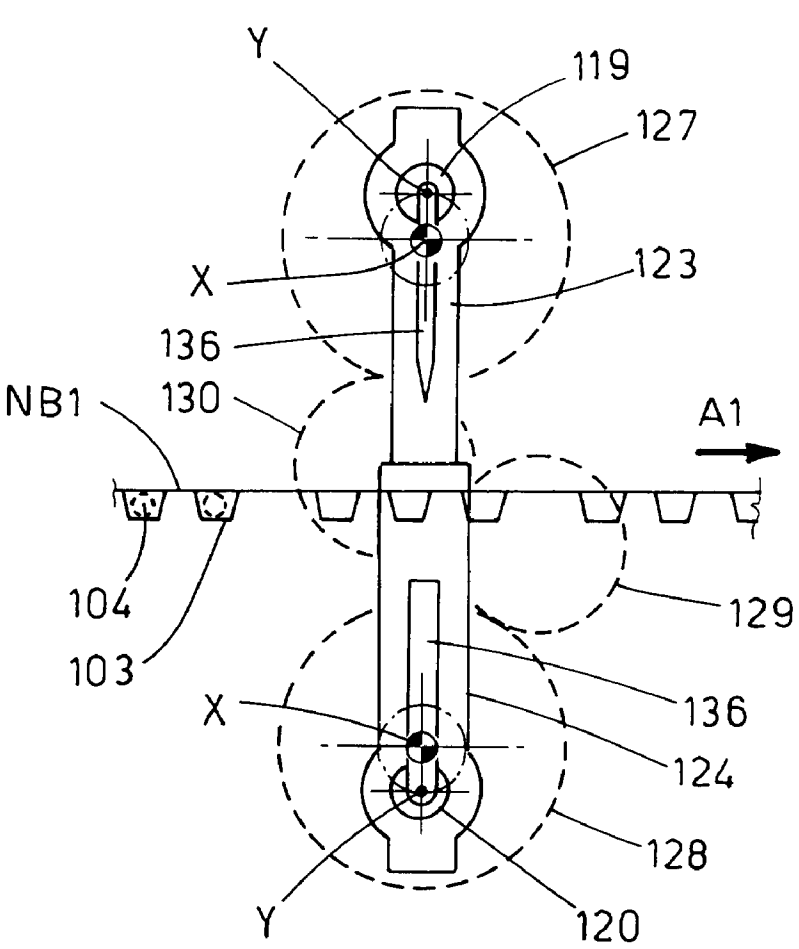
Figure 8:
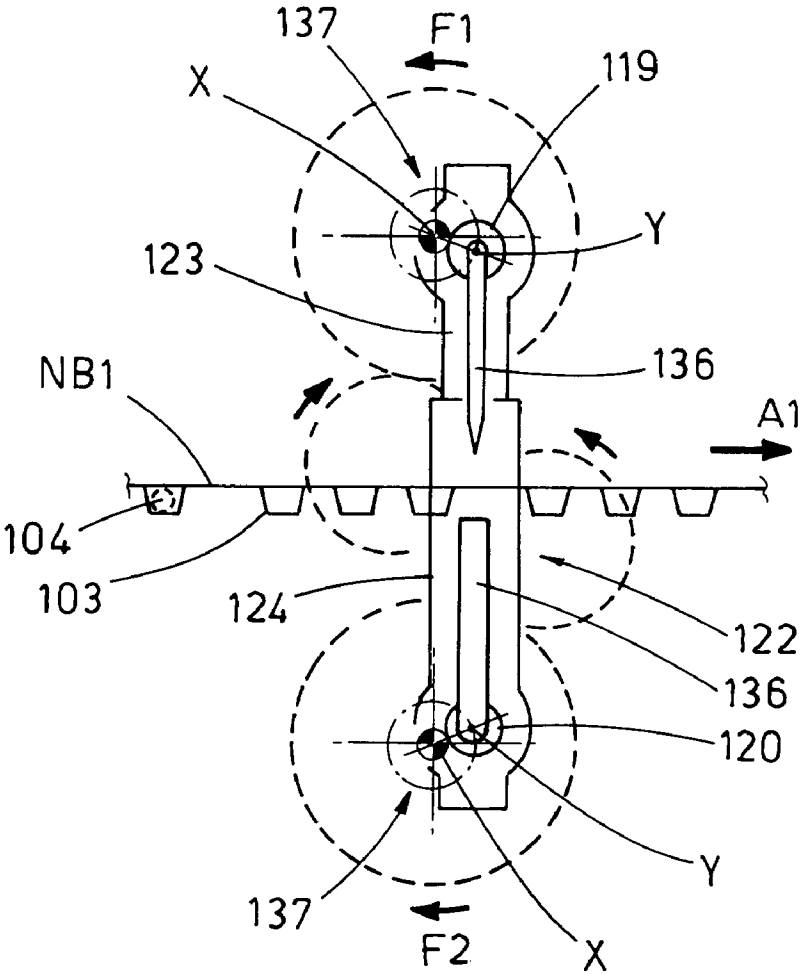

According to FIGS. 4 and 5 and to the schemes of FIGS. 7 to 9, each tubular element 125, 126 and the relative ring 127, 128 extends eccentrically around their rotation axis X, parallel to the extension axis Y of the relative support shaft 119, 120, so as to define a connecting rod—crank driving mechanism with the relative shafts 119 and 120, and to allow, during their rotation, the above mentioned working cycle including the first and second working step of moving close and, respectively, moving away of the plates 133 and 134 to and from the blister band NB1.

Figure 6:
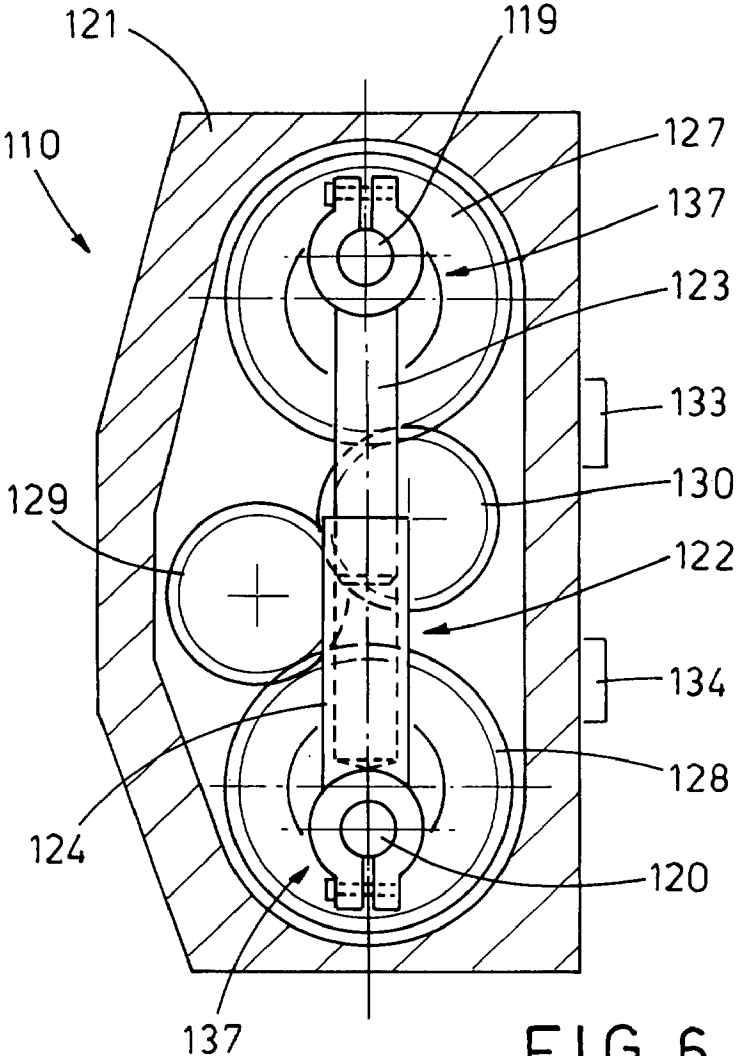
FIG. 6 is a rear view of the work station of FIGS. 4 and 5.

According to FIG. 6, the toothed roller 129, motorized and engaged with at least one of the toothed rings 127, 128 by the interposition of an idle roller 130, so as to allow the two toothed rings 127 and 128 to rotate in an opposite direction, in order to perform a correct cycle of the means 135 and 136 (see arrows F1 and F2 of FIG. 8).

Practically, during the use, the processing steps are performed on the band NB1 feeding continuously along the horizontal path A1.

This is possible due to a working cycle (visible for prefixed moments in FIGS. 7 to 9), in which the incision/pre-cutting means 136 perform the second working step of moving away from the band NB1.

Then, immediately after having touched the band NB1 (FIG. 7), the means 136, following the feeding of the band NB1, move away through a trajectory T, which does not interfere with the feeding of the band NB1 and with the blisters 103, that is raising and relative lowering of the plates 133 and 134 (FIG. 8), with the contemporary discordant movement of the plates 133 and 134.

The last step of the working cycle finishes with a maximum moving away of the two plates 133 and 134 and a prefixed discordant feeding of the plates 133 and 134 (FIG. 9).

The trajectory T reversally performed defines the first working step, in which the two plates 133 and 134 move close to the band NB1, to perform the relative treatments on the band NB1.

Consequently, the blistering machine M1 structured in this way reaches the objects, due to a simplified production line, which assures a compact structure, together with a simple arrangement and operations of the parts constituting the punching/printing station and, respectively the incision/pre-cutting station, operations which are perfectly compatible with the continuous feeding of the bands.

The proposed invention is doubtlessly advantageous for the dimensions, the finishing quality of the obtained blister packs, as well as for the possibility of increasing the production speed.

The so conceived invention is susceptible of many changes and variants, all remaining within its inventive concept. Moreover, all the details can be substituted by technically equivalent elements.

The invention claimed is:

1. A blistering machine for producing blister packs comprising:

a product feeding station for feeding products to be packaged;

a production line extending substantially horizontal from said products feeding station, along a continuous feeding path, said production line including:

at least one thermoforming station for thermoforming a first continuous band of thermoformable material to form a blister band containing a plurality of blisters for receiving the products therein;

a filling station for filling the plurality of blisters in said blister band with the products;

an overlay band feeding station for continuously feeding a second continuous band over the blister band filled with said products;

a closing station for sealing said blister band with said second continuous band to form a blister pack band;

at least one processing station for performing a process selected from the group consisting of printing, pre-cutting, incision, and combinations thereof on said blister pack band as said blister pack band moves along said continuous feeding path, said at least one processing station containing processing means operable on said blister pack band to perform said selected process; and, a cutting station for cutting said blister pack band into a plurality of blister packs;

said at least one processing station having:

plate supporting means for supporting said processing means;

rotating and reciprocating means for cyclically moving said plate supporting means first in a direction toward said blister pack band then moving along said feeding path with said blister pack band and then away from said blister pack band with return to the position for moving again toward said blister pack band, in a continuous cycle, the rotating and reciprocating means operating in synchrony with the feeding of the blister pack band along the feeding path, thereby defining a work cycle having a first step for moving said plate supporting means close to said blister pack band, to touch said blister pack band and to move together with said blister pack band, and a second step for moving said plate supporting means away from said blister pack band, and back to an initial position for repeating the work cycle, so that said at least one processing means move toward and away from the blister pack band and follow the blister pack band along said path when the processing means are acting on said blister band pack, said plate supporting means including:

a pair of counter-facing, cooperating plates disposed on opposite sides with respect to said blister pack band;

a pair of shafts, each shaft supporting a respective plate;

rotating crank means for circularly driving each shaft for moving said plates close to and away from said blister pack band, and in synchrony with the band moving along the feeding path; and mutual alignment means for maintaining the pair of plates in parallel alignment, said alignment means including two arms, each arm having an end connected to a respective shaft, one of the two arms being slidingly received within another of the two arms so that the two arms are telescopically coupled to each other.

* * * * *